US010886078B2

(12) United States Patent
Fu

(10) Patent No.: US 10,886,078 B2
(45) Date of Patent: Jan. 5, 2021

(54) BUTTON, SWITCH ASSEMBLY AND COMPUTER HOST

(71) Applicant: Wistron Corp., New Taipei (TW)

(72) Inventor: Zhao-Ping Fu, New Taipei (TW)

(73) Assignee: WISTRON CORP., New Taipei (TW)

( * ) Notice: Subject to any disclaimer, the term of this patent is extended or adjusted under 35 U.S.C. 154(b) by 27 days.

(21) Appl. No.: 16/212,743

(22) Filed: Dec. 7, 2018

(65) Prior Publication Data

US 2020/0027671 A1 Jan. 23, 2020

(30) Foreign Application Priority Data

Jul. 17, 2018 (CN) ..... 2018 2 1136293 U

(51) Int. Cl.

| | |
|---|---|
| ***H01H 13/10*** | (2006.01) |
| ***H01H 13/14*** | (2006.01) |
| *H01H 13/52* | (2006.01) |
| *H01H 13/02* | (2006.01) |

(52) U.S. Cl.

CPC ..... *H01H 13/10* (2013.01); *H01H 13/14* (2013.01); *H01H 13/023* (2013.01); *H01H 13/52* (2013.01); *H01H 2217/01* (2013.01); *H01H 2219/062* (2013.01); *H01H 2221/026* (2013.01); *H01H 2221/058* (2013.01); *H01H 2221/06* (2013.01); *H01H 2231/002* (2013.01)

(58) Field of Classification Search

CPC .... H01H 13/14; H01H 3/125; H01H 13/7065; H01H 13/704; H01H 2221/044; H01H 13/20; H01H 13/50; H01H 2205/024; H01H 3/12; H01H 13/02; H01H 13/10; H01H 13/52; H01H 2217/01; H01H 2231/002; H01H 2221/06; H01H 2221/026; H01H 2219/062; H01H 13/023; H01H 2221/058; H01H 2225/028; H01H 2221/04

See application file for complete search history.

(56) References Cited

U.S. PATENT DOCUMENTS 10,437,400 B2 * 10/2019 Sah ..... G06F 3/02
2011/0036693 A1 * 2/2011 Lin ..... H01H 13/023 200/314

* cited by examiner

*Primary Examiner* — Ahmed M Saeed
(74) *Attorney, Agent, or Firm* — Locke Lord LLP; Tim Tingkang Xia, Esq.

(57) ABSTRACT

The disclosure provides a button. The button includes at least one guiding component and a main body. The main body has at least one guiding surface. The guiding surface of the main body is slidably connected to the guiding component so as to allow the guiding component to guide the main body to move. In addition, the disclosure also provides a switch assembly and a computer host that have the button.

15 Claims, 8 Drawing Sheets

BUTTON, SWITCH ASSEMBLY AND COMPUTER HOST

CROSS-REFERENCE TO RELATED APPLICATIONS

This non-provisional application claims priority under 35 U.S.C. § 119(a) on Patent Application No(s). 201821136293.6 filed in China on Jul. 17, 2018, the entire contents of which are hereby incorporated by reference.

TECHNICAL FIELD

The disclosure relates to a button, a switch assembly and the computer host, more particular a button, a switch assembly and a computer host that have a guiding component for guiding direction.

BACKGROUND

A button is a switch mechanism for controlling some aspects of an electronic product, such as a power button of a notebook computer or desktop computer or a SID switch button. In order to provide a good tactile feedback and make the button responsive, the configuration of the button is a critical factor.

Taking a notebook computer for instance, except for a circle-shaped button, there are rectangular-shaped buttons on the notebook computer. But the rectangular-shaped button is easily pivoted to fail to activate the switch when an external force applied to the button is not uniform. In detail, due to the shape of the rectangular button, the rectangular button is easily pivoted and off track from the path for activating the switch when a force is applied to the end portion of the button, consequently, the button may have a high chance of being moved in a wrong direction and being stuck in the casing.

SUMMARY OF THE INVENTION

One embodiment of the disclosure provides a button The button includes at least one guiding component and a main body. The main body has at least one guiding surface. The guiding surface of the main body is slidably connected to the guiding component so as to allow the guiding component to guide the main body to move.

Still another embodiment of the disclosure provides a switch assembly which is configured to be mounted to a casing. The switch assembly includes a switch and a button. The switch is configured to be mounted in the casing. The button, configured to press the switch, includes at least one guiding component and a main body. The guiding component is configured to be fixed in the casing. The main body is configured to be slidably disposed on the casing. The main body has at least one guiding surface. The guiding surface is slidably connected to the guiding component so as to allow the guiding component to guiding the main body to move toward or away from the switch.

Yet another embodiment of the disclosure provides a computer host. The computer host includes a casing, a switch and a button. The switch is mounted in the casing. The button is configured to press the switch. The button includes at least one guiding component and a main body. The guiding component is fixed in the casing. The main body slidably disposed on the casing. The main body has at least one guiding surface. The guiding surface of the main body is slidably connected to the guiding component so as to allow the guiding component to guide the main body to move toward or away from the switch.

BRIEF DESCRIPTION OF THE DRAWINGS

The present disclosure will become better understood from the detailed description given herein below and the accompanying drawings which are given by way of illustration only and thus are not intending to limit the present disclosure and wherein.

DETAILED DESCRIPTION

Figure 1:
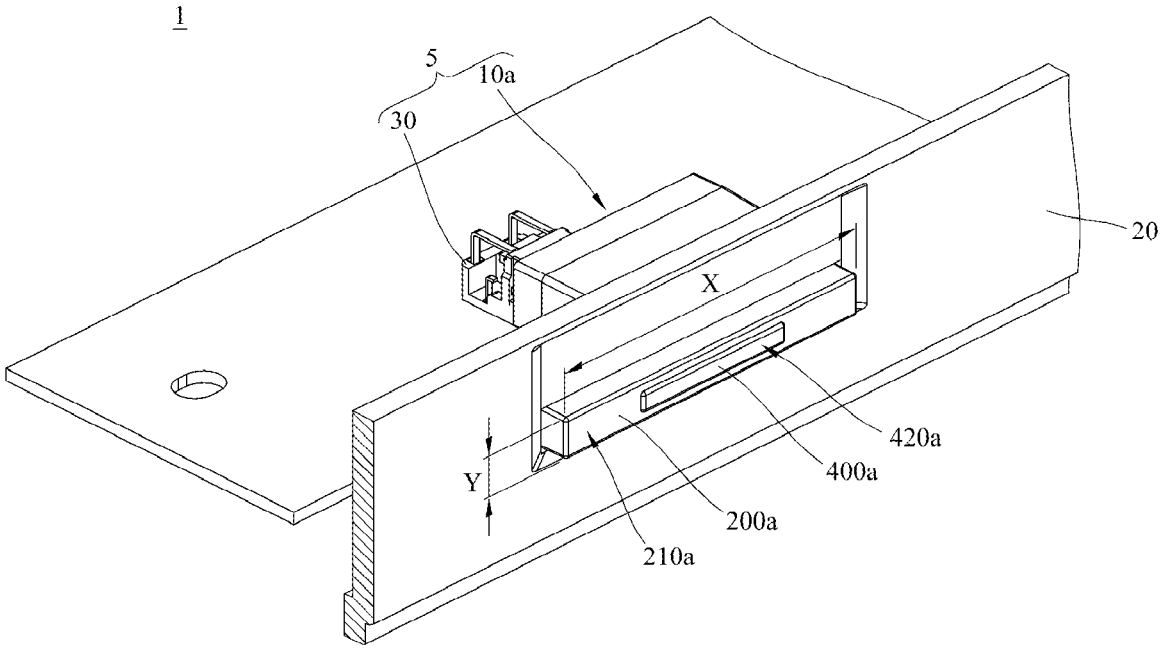
FIG. 1 is a perspective view of a button, a casing and a switch according to a first embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
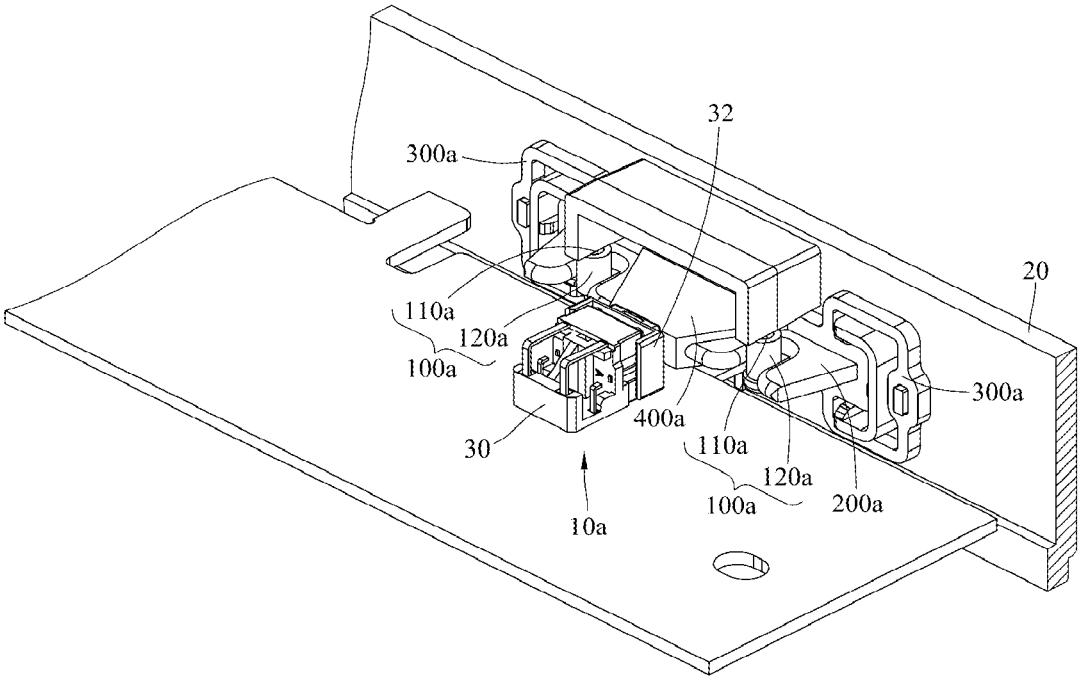
FIG. 2 is another perspective view of the button, the casing and the switch in FIG. 1.
Figure 3:
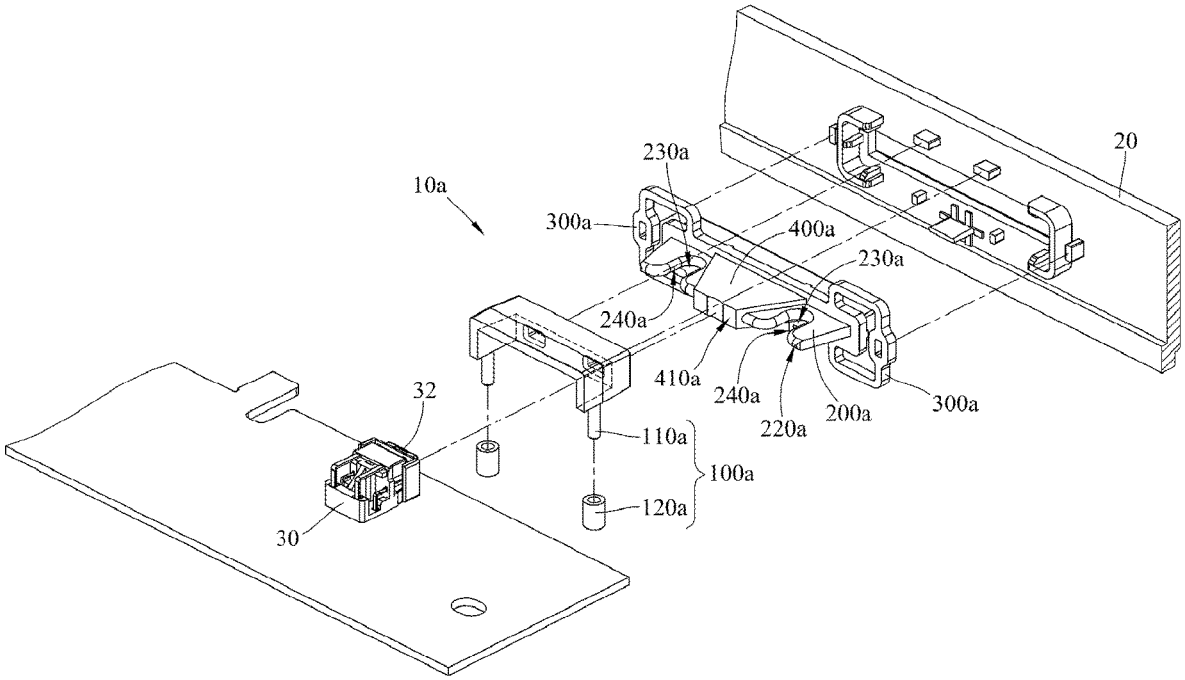
FIG. 3 is an exploded view of the button, the casing and the switch in FIG. 2.
Figure 4:
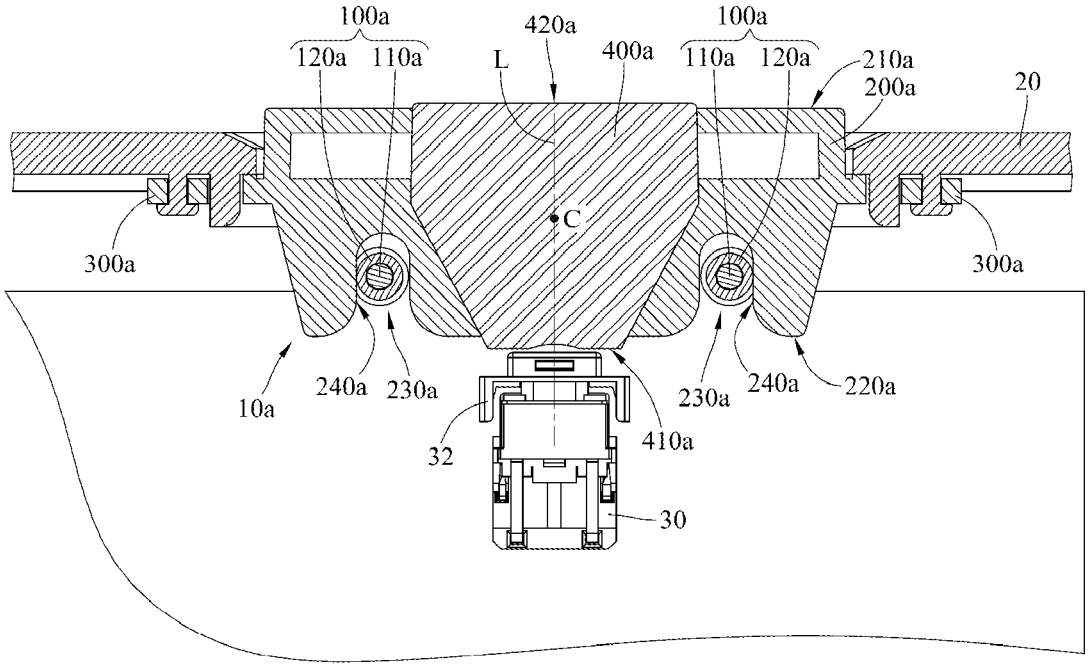
FIG. 4 is a partial enlarged cross-sectional view of the button, the casing and the switch in FIG. 2.

Please refer to FIG. 1 to FIG. 4. FIG. 1 is a perspective view of a button, a casing and a switch according to a first embodiment of the disclosure. FIG. 2 is another perspective view of the button, the casing and the switch in FIG. 1. FIG. 3 is an exploded view of the button, the casing and the switch in FIG. 2. FIG. 4 is a partial enlarged cross-sectional view of the button, the casing and the switch in FIG. 2.

As shown in FIG. 1 and FIG. 2, this embodiment provides a computer casing 1. The computer casing 1 includes a switch assembly 5 and a casing 20. The switch assembly 5 is mounted on the casing 20, and the switch assembly 5 includes a button 10*a* and a switch 30. The button 10*a* is configured to press the switch 30 which is located in the casing 20. The casing 20 is, for example, a casing of a server or a desktop computer. The switch 30 is, for example, a SID switch or a power switch. The switch 30 has a press part 32. Pressing the press part 32 is able to switch the switch 30 from an activated state to an inactivated state or from the inactivated state to the activated state.

As shown in FIG. 3 and FIG. 4, the button 10*a* includes two guiding components 100*a*, a main body 200*a* and two elastic arms 300*a*. Each of the guiding components 100*a* includes a mount post 110*a* and a rotatable component 120*a*. The two mount posts 110*a* are fixed to the casing 20*a* by, for example, partially melting them. In this embodiment, the rotatable components 120*a* are hollow cylinders, and the two rotatable components 120*a* are respectively and rotatably sleeved on the two mount posts 110*a*. In this or another embodiment, there may be a flange on an end of each mount post 110*a* that can prevent the rotatable component 120*a* from falling off from the mount post 110*a*, and the flange may be made from partially melting the end of the mount post 110*a*. In other embodiments, there may be a ring-shaped stopper sleeved on the end of the mount post for preventing the rotatable component from falling off.

In the disclosure, the rotatable component 120*a* may not be a hollow cylindrical component. In some other embodiments, the rotatable component may be in a bead-shaped component.

From the view of FIG. 1, the front side of the main body 200*a* of the button 10*a* is in, for example, a long and narrow shape. As shown in FIG. 1, the ratio of the length X of the main body 200*a* to the width Y of the main body 200*a* is larger than 3. The main body 200*a* is slidably disposed on the casing 20 so that the main body 200*a* is movable toward or away from the switch 30. In detail, as shown in FIGS. 1 and 3, the main body 200*a* has a first side surface 210*a*, a second side surface 220*a* and two grooves 230*a*. The second side surface 220*a* is opposite to the first side surface 210*a*. In other words, the first side surface 210*a* is at the front side of the main body 200*a*, and the second side surface 220*a* is at the rear side of the main body 200*a*. The first side surface 210*a* is configured to be pressed by an external force, and the second side surface 220*a* can be moved toward or away from the switch 30 while the external force is applied on the first side surface 210*a*.

Defining a central line L passing through both the switch 30 and a central point C of the main body 200*a*, the two grooves 230*a* extend from the second side surface 220*a* toward the first side surface 210*a*, and the two grooves 230*a* are respectively located on two opposite sides of the central line L. Each of the two grooves 230*a* has a guiding surface 240*a* which is located on a side of the groove 230*a* facing the central line L. That is, the two guiding surfaces 240*a* extend from the second side surface 220*a* toward the first side surface 210*a*. The two rotatable components 120*a* of the two guiding components 100*a* are respectively in contact with the two guiding surfaces 240*a*. Therefore, when the main body 200*a* is moved toward or away from the switch 30, the two rotatable components 120*a* of the two guiding components 100*a* can guide the movement of the main body 200*a* in a rotating manner.

In addition, in this embodiment, the guiding surface 240*a* is a curved surface, which helps to reduce the contact area between the guiding surface 240*a* and the rotatable component 120*a* so as to enable the main body 200*a* to smoothly move with respect to the casing 20. However, the guiding surface 240*a* may not be a curved surface. For example, in some other embodiments, the guiding surface may be a flat surface; in such a case, the rotatable component may be a bead-shaped component, such that the contact area between the guiding surface and the rotatable component is still small.

Furthermore, the shape of the front side of the main body 200*a* is not restricted. For example, in some other embodiments, the shape of the front side of the main body may be in a circle or triangle.

Two ends of the two elastic arms 300*a* are respectively connected to two opposite sides of the main body 200*a*, and the other ends of the two elastic arms 300*a* are configured to be fixed to the casing 20. The two elastic arms 300*a* are configured to provide elastic potential energy for spring the main body 200*a* back to its original position. It is noted that the quantity of the elastic arms 300*a* is not restricted. For example, in some other embodiments, the button may only include one elastic arm 300*a*. Furthermore, the shape of the elastic arm 300*a* is either not restricted. For example, in some other embodiments, the button may only include one elastic arm and the elastic arm may be in a ring shape surrounding the main body.

In addition, in this embodiment, the main body 200*a* can be moved back to its original position by the elastic force provided by the elastic arms 300*a*, but the present disclosure is not limited thereto. In some other embodiments, the elastic arm may be replaced with a spring, and two opposite ends of the spring are respectively connected to the casing and main body, such that the spring is able to spring the main body back to its original position.

The button 10*a* of this embodiment further includes a light guiding component 400*a*. The light guiding component 400*a* is embedded into the main body 200*a*, and the light guiding component 400*a* has an incident surface 410*a* and an illuminating surface 420*a*. The incident surface 410*a* faces the switch 30, and the illuminating surface 420*a* is exposed from the front side of the casing 20. The incident surface 410*a* is configured to receive and guide light emitted by a light source (not shown in figures) on the switch 30 to the illuminating surface 420*a*.

Figure 5:
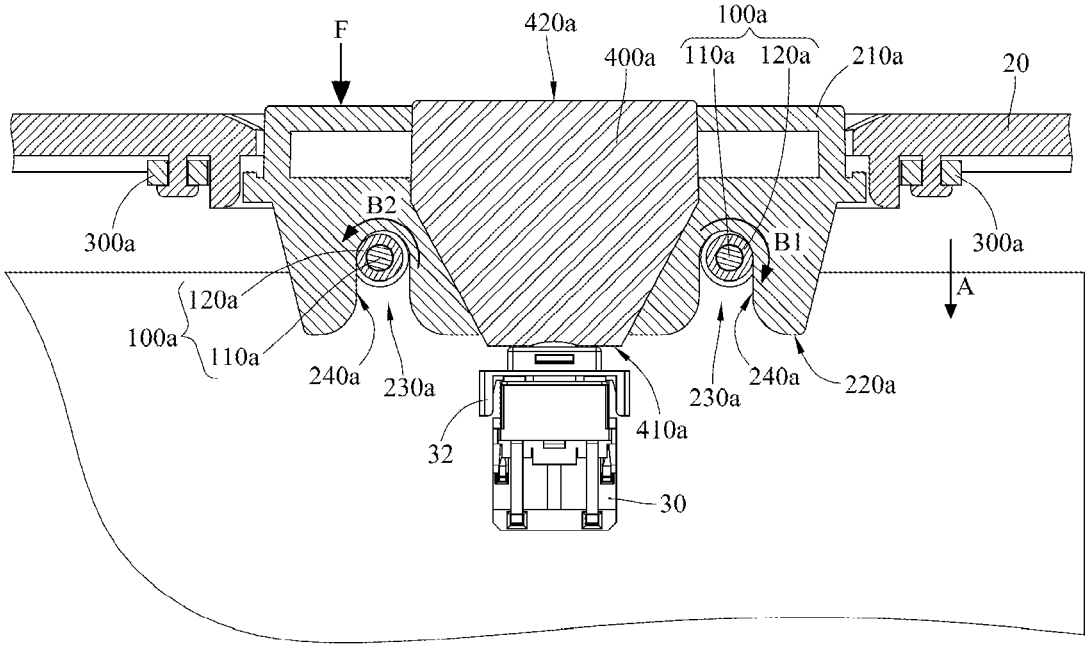
FIG. 5 is the partial enlarged cross-sectional view of the button, the casing and the switch in FIG. 4 while a main body of the button is pressed.

Please refer to FIG. 4 and FIG. 5. FIG. 5 is the partial enlarged cross-sectional view of the button, the casing and the switch in FIG. 4 while a main body of the button is pressed.

When an external force is applied on an area that away from the central area of the first side surface 210*a* of the main body 200*a*, the main body 200*a* may experience a large pivot torque, but with the help of the rotatable components 120*a* sliding along the guiding surfaces 240*a*, the main body 200*a* is able to be moved along the desired direction, thereby preventing the main body 200*a* from pivoting to get stuck in the casing 20 and preventing the light guiding component 400*a* from being off track from the path for activating the switch 30. That is, the guiding components 100*a* ensure the main body 200*a* to move along a straight direction toward the switch 30 (e.g., a direction A as shown in the figure) even when the force is not applied on the central area of the front side of the main body 200*a*. Also, during the movement of the main body 200*a* along the direction A, the guiding surfaces 240*a* force the rotatable components 120*a* to respectively rotate in a direction B1 and B2, therefore the friction between the main body 200*a* and the guiding components 100*a* can be reduced, thereby enabling the main body 200*a* to move smoothly with respect to the casing 20.

It is understood that, in the case that the ratio of the length to the width of the main body 200*a* is larger than 3, the main body 200*a* may experience a much more significant pivot torque when a force is applied on its right or left side. But the guiding component 100*a* still can maintain the moving direction of the main body 200*a*. However, it does not mean that the rotatable components 120*a* are exclusive to the main body 200*a*. In contrast to the conventional button, since the conventional button does not have the guiding component 100*a*, it is easily being pivoted to fail to activate the switch when the force applied thereon is uniform.

In this embodiment, the aforementioned computer casing 1*a* is a part of a computer host; that is, the computer host includes the switch assembly 5 and the casing 20. The computer host is, for example, a server, a desktop computer or a laptop computer.

Figure 6:
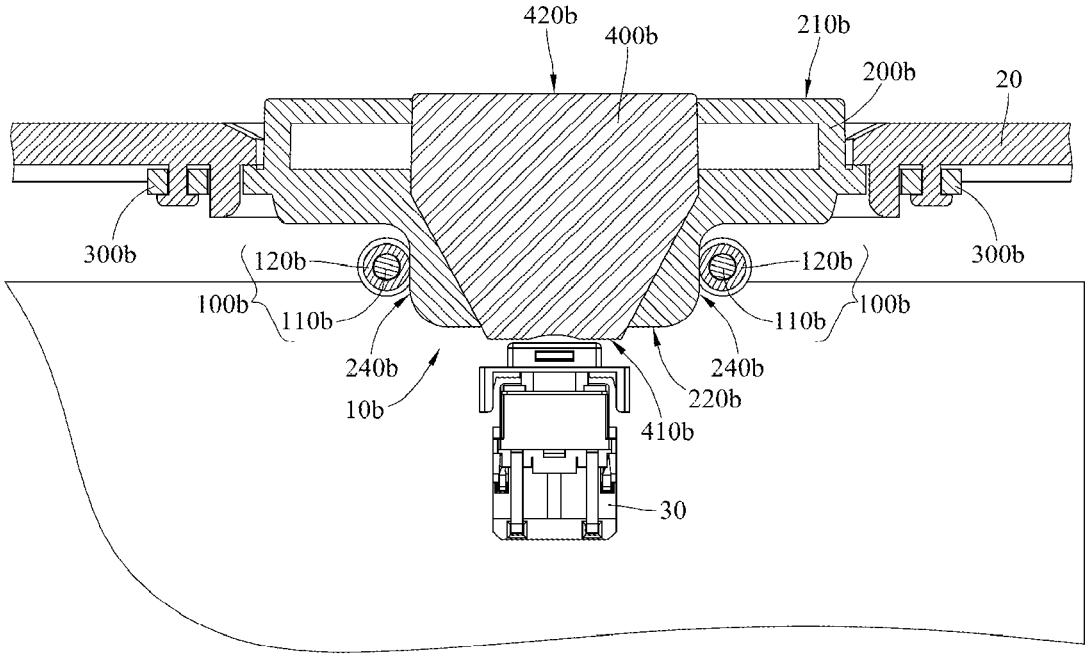
FIG. 6 is a cross-sectional view of a button, a casing and a switch according to a second embodiment of the disclosure.

Moreover, the locations of the guiding surfaces 240*a* are not restricted. In some other embodiments, the two guiding surface may be respectively located on the surfaces of the grooves facing away from the central line L. As the embodiment provided in FIG. 6, FIG. 6 is a cross-sectional view of a button, a casing and a switch according to a second embodiment of the disclosure.

This embodiment provides a computer casing that is similar to the computer casing 1 of the first embodiment. For the purpose of illustration, the following paragraphs only illustrates the differences therebetween and components that are related to the differences.

In this embodiment, a button 10*b* includes two guiding components 100*b*, a main body 200*b*, two elastic arms 300*b* and a light guiding component 400*b* having an incident surface 410*b* and an illuminating surface 420*b*. Each of the two guiding components 100*b* includes a mount post 110*b* and a rotatable component 120*b*. The mount posts 110*b* are fixed to the casing 20, and the two rotatable components 120*b* are respectively and rotatably sleeved on the two mount posts 110*b*. The main body 200*b* has no groove, the main body 200*b* has a first side surface 210*b*, a second side surface 220*b* and two guiding surfaces 240*b*. The second side surface 220*b* is opposite to the first side surface 210*b*. In other words, the first side surface 210*b* is at the front side of the main body 200*b*, and the second side surface 220*b* is at the rear side of the main body 200*b*. The first side surface 210*b* is configured to be pressed by an external force, and the second side surface 220*b* can be moved toward or away from the switch 30 while the external force is applied on the first side surface 210*b*. The two guiding surfaces 240*b* are connected to the second side surface 220*b* and extend from the second side surface 220*b* toward the first side surface 210*b*. Two rotatable components 120*b* of the two guiding components 100*b* are respectively in contact with the two guiding surfaces 240*b*. Therefore, when the main body 200*b* is moved toward or away from the switch 30, the two rotatable components 120*b* of the two guiding components 100*b* can guide the movement of the main body 200*b* in a rotating manner.

Figure 7:
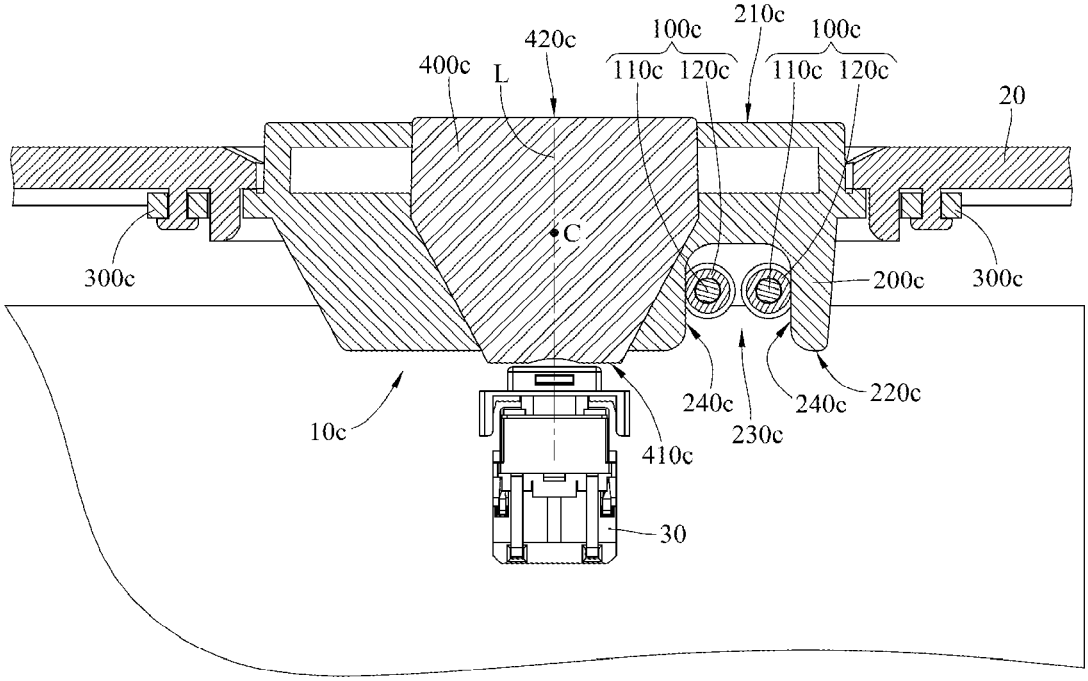
FIG. 7 is a cross-sectional view of a button, a casing and a switch according to a third embodiment of the disclosure.

Then, please refer to FIG. 7. FIG. 7 is a cross-sectional view of a button, a casing and a switch according to a third embodiment of the disclosure.

This embodiment provides a computer casing that is similar to the computer casing 1 of the first embodiment. For the purpose of illustration, the following paragraphs only illustrates the differences therebetween and components that are related to the differences.

In this embodiment, a button 10*c* includes two guiding components 100*c*, a main body 200*c*, two elastic arms 300*c* and a light guiding component 400*c* having an incident surface 410*c* and an illuminating surface 420*c*. Each of the two guiding components 100*c* includes a mount post 110*c* and a rotatable component 120*c*. The mount posts 110*c* are fixed to the casing 20, and the two rotatable components 120*c* are respectively and rotatably sleeved on the two mount posts 110*c*. The main body 200*c* has a first side surface 210*c*, a second side surface 220*c* and a groove 230*c*. The second side surface 220*c* is opposite to the first side surface 210*c*. In other words, the first side surface 210*c* is at the front side of the main body 200*c*, and the second side surface 220*c* is at the rear side of the main body 200*c*. The first side surface 210*c* is configured to be pressed by an external force, and the second side surface 220*c* can be moved toward or away from the switch 30 while the external force is applied on the first side surface 210*c*. The groove 230*c* extends from the second side surface 220*c* toward the first side surface 210*c*, and the groove 230*c* is located on a side of a central line L passing through both the switch 30 and a central point C of the main body 200*c*. The groove 230*c* has two guiding surfaces 240*c* opposite to each other. That is, the two guiding surfaces 240*c* extend from the second side surface 220*c* toward the first side surface 210*c*. Two rotatable components 120*c* of the two guiding components 100*c* are separated from each other and respectively in contact with the two guiding surfaces 240*c*. Therefore, when the main body 200*c* is moved toward or away from the switch 30, the two rotatable components 120*c* of the two guiding components 100*c* can guide the movement of the main body 200*c* in a rotating manner.

Figure 8:
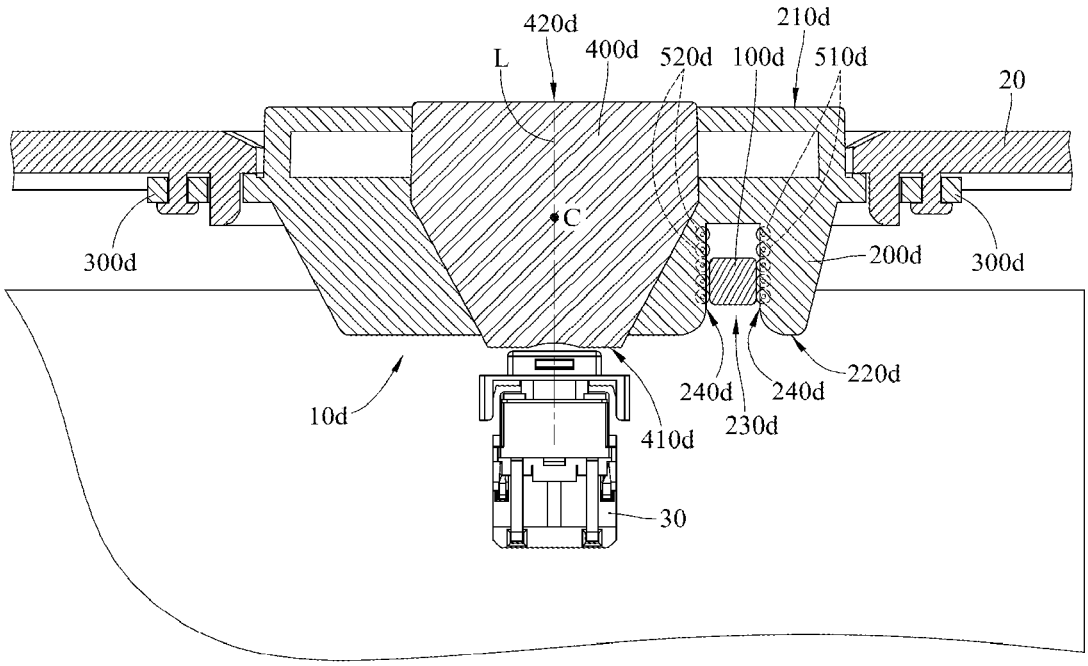
FIG. 8 is a cross-sectional view of a button, a casing and a switch according to a fourth embodiment of the disclosure.

Then, please refer to FIG. 8. FIG. 8 is a cross-sectional view of a button, a casing and a switch according to a fourth embodiment of the disclosure.

This embodiment provides a computer casing that is similar to the computer casing 1 of the first embodiment. For the purpose of illustration, the following paragraphs only illustrates the differences therebetween and components that are related to the differences.

In this embodiment, a button 10*d* includes a guiding component 100*d*, a main body 200*d*, two elastic arms 300*d* and a light guiding component 400*d* having an incident surface 410*d* and an illuminating surface 420*d*, a plurality of first rotatable components 510*d* and a plurality of second rotatable components 520*d*. The guiding component 100*d* is, for example, a square post. The guiding component 100*d* is fixed on the casing 20. The main body 200*d* has a first side surface 210*d*, a second side surface 220*d* and a groove 230*d*. The second side surface 220*d* is opposite to the first side surface 210*d*. In other words, the first side surface 210*d* is at the front side of the main body 200*d*, and the second side surface 220*d* is at the rear side of the main body 200*d*. The first side surface 210*d* is configured to be pressed by an external force, and the second side surface 220*d* can be moved toward or away from the switch 30 while the external force is applied on the first side surface 210*d*. The groove 230*d* extend from the second side surface 220*d* toward the first side surface 210*d*, and the groove 230*d* is located on a side of a central line L passing through both the switch 30 and a central point C of the main body 200*d*. The groove 230*d* has two guiding surfaces 240*d* opposite to each other. That is, the two guiding surfaces 240*d* extend from the second side surface 220*d* toward the first side surface 210*d*.

The first rotatable components 510*d* and the second rotatable components 520*d* are disposed on the main body 200*d* and respectively arranged along the two guiding surfaces 240*d*, and two opposite sides of the guiding component 100*d* are respectively in contact with the first rotatable components 510*d* and the second rotatable components 520*d*. As such, when the main body 200*d* is moved toward or away from the switch 30, the first rotatable components 510*d* and the second rotatable components 520*d* can guide the movement of the main body 200*d* in a rotating manner.

According to the button, the switch assembly and the computer host as discussed above, by the rotatable components respectively in contact with the opposite guiding surfaces or the opposite sides of the guiding component, the main body is able to be guided in the desired direction and to be prevented from pivoting; that is, the main body is ensured to be moved in a straight direction toward the switch, such that the main body is prevent from being stuck in the casing and the light guiding component on the main body is prevented from being off track from the path for activating the switch, thereby enhancing the tactile feedback of the button.

In addition, during the movement of the main body moving toward the switch, the guiding surfaces force the rotatable components to rotate, therefore the friction between the main body and the guiding components can be reduced, thereby enabling the main body to move smoothly with respect to the casing.

Furthermore, the grooves are respectively located on two opposite of the central line, which allows the middle portion to have a larger area for accommodating the light guiding component, such that the light guiding component can be located closer to the switch and helps to decrease light loss.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A button, comprising: at least one guiding component; and a main body being movable along a movable direction and having a first side surface, a second side surface opposite to the first side surface, and at least one groove recessed along the movable direction so that the at least one groove has an opening at the second side surface and a closed end which is located between the first side surface and the opening, wherein the main body further has at least one guiding surface being a side surface of the at least one groove located between the opening and the closed end of the at least one groove so that the at least one guiding component is slidable between the opening and the closed end of the at least one groove along the at least one guiding surface so as to guide the main body to move along the movable direction; wherein the at least one guiding component comprises a mount post and a rotatable component, the mount post is configured to be fixed in a casing, and the rotatable component is rotatably disposed on the mount post, the at least one guiding surface of the main body is in contact with the rotatable component so as to allow the rotatable component to guide the main body to move toward or away from a switch.

2. The button according to claim 1, wherein the first side surface is configured to be pressed by an external force so as to force the second side surface to move toward a switch, and the at least one guiding surface is connected to the second side surface and extends from the second side surface toward the first side surface.

3. The button according to claim 1, wherein a central line is defined to pass through the switch and a central point of the main body, the quantity of the at least one groove is two, the quantity of the at least one guiding surface is two, the two grooves are respectively located on two opposite sides of the central line, each of the two grooves has two side surfaces opposite to each other, the two guiding surfaces are respectively the side surfaces of the two grooves facing away from the central line, the quantity of the at least one guiding component is two, and the two rotatable components of the two guiding components are respectively in contact with the two guiding surfaces.

4. The button according to claim 1, wherein a central line is defined to pass through both the switch and a central point of the main body, the quantity of the at least one groove is two, the quantity of the at least one guiding surface is two, the two grooves are spaced apart from the central line and are respectively located on two opposite sides of the central line, each of the two grooves has two side surfaces opposite to each other, the two guiding surfaces are respectively the side surfaces of the two grooves facing the central line, the quantity of the at least one guiding component is two, and the two rotatable components of the two guiding components are respectively in contact with the two guiding surfaces.

5. The button according to claim 1, wherein a central line is defined to pass through both the switch and a central point of the main body, the quantity of the at least one guiding surface is two, the at least one groove is located on a side of the central line, the two guiding surfaces are respectively two side surfaces of the at least one groove opposite to each other, the quantity of the at least one guiding component is two, and the two rotatable components of the two guiding components are respectively in contact with the two guiding surfaces.

6. The button according to claim 1, further comprising a plurality of rotatable components, wherein the at least one guiding component is configured to be fixed in a casing, the plurality of rotatable components are rotatably disposed on the main body and arranged along the at least guiding surface, and the at least one guiding component is in contact with the plurality of rotatable components.

7. The button according to claim 6, wherein the quantity of the at least one guiding surface is two, the two guiding surfaces are respectively two side surfaces of the at least one groove opposite to each other, the plurality of rotatable components are divided into a plurality of first rotatable components and a plurality of second rotatable components, the plurality of the first rotatable components and the plurality of second rotatable components are respectively arranged along the two guiding surfaces, and two opposite sides of the at least one guiding component are respectively in contact with the plurality of first rotatable components and the plurality of second rotatable components.

8. The button according to claim 1, further comprising at least one elastic arm, wherein an end of the at least one elastic arm is connected to the main body, and the other end of the at least one elastic arm is configured to be fixed to a casing.

9. The button according to claim 8, wherein the quantity of the at least one elastic arm is two, and the two elastic arms are respectively connected to two opposite sides of the main body.

10. The button according to claim 1, further comprising a light guiding component, wherein the light guiding component is embedded into the main body, the light guiding component has an incident surface and an illuminating surface, the incident surface faces a switch, the illuminating surface is exposed from a casing, and the incident surface is configured to receive and guide light emitted by a light source on the switch to the illuminating surface.

11. The button according to claim 1, wherein a ratio of a length of the main body to a width of the main body is larger than 3.

12. The button according to claim 1, wherein the at least one guiding surface is a curved surface.

13. A switch assembly, configured to be mounted to a casing, comprising: a switch configured to be mounted in the casing; and a button, configured to press the switch, comprising: at least one guiding component configured to be fixed in the casing; and a main body configured to be slidably disposed on the casing and movable along a movable direction, the main body having a first side surface, a second side surface opposite to the first side surface, and at least one groove recessed along the movable direction so that the at least one groove has an opening at the second side surface and a closed end which is located between the first side surface and the opening, wherein the main body further has at least one guiding surface being a side surface of the at least one groove located between the opening and the closed end of the at least one groove so that the at least one guiding component is slidable between the opening and the closed end of the at least one groove along the at least one guiding surface so as to guide the main body to move along the movable direction with respect to the casing; wherein the at least one guiding component comprises a mount post and a rotatable component, the mount post is configured to be fixed in the casing, and the rotatable component is rotatably disposed on the mount post, the at least one guiding surface of the main body is in contact with the rotatable component so as to allow the rotatable component to guide the main body to move toward or away from the switch.

14. A computer host, comprising: a casing; a switch mounted in the casing; and a button, configured to press the switch, comprising: at least one guiding component fixed in the casing; and a main body slidably disposed on the casing along a movable direction, the main body having a first side surface, a second side surface opposite to the first side surface, and at least one groove recessed along the movable direction from the second side surface so that the at least one groove has an opening at the second side surface and a closed end which is located between the first side surface and the opening, wherein the main body further has at least one guiding surface being a side surface of the at least one groove located between the opening and the closed end of the at least one groove so that the at least one guiding component is slidable between the opening and the closed end of the at least one groove along the at least one guiding surface so as to guide the main body to move along the movable direction with respect to the casing; wherein the at least one guiding component comprises a mount post and a rotatable component, the mount post is fixed in the casing, and the rotatable component is rotatably disposed on the mount post, the at least one guiding surface of the main body is in contact with the rotatable component so as to allow the rotatable component to guide the main body to move toward or away from the switch.

15. The computer host according to claim 14, wherein a central line is defined to pass through both the switch and a central point of the main body, the quantity of the at least one groove is two, the quantity of the at least one guiding surface is two, the two grooves are spaced apart from the central line and are respectively located on two opposite sides of the central line, each of the two grooves has two side surfaces opposite to each other, the two guiding surfaces are respectively the side surfaces of the two grooves facing the central line, the quantity of the at least one guiding component is two, and the two rotatable components of the two guiding components are respectively in contact with the two guiding surfaces.

* * * * *